United States Patent [19]

Rodriguez

[11] 4,023,035

[45] May 10, 1977

[54] LIGHT SENSITIVE LAMP ADAPTER

[75] Inventor: Edward T. Rodriguez, Reading, Mass.

[73] Assignee: Creative Technology Corporation, Salem, Mass.

[22] Filed: Dec. 12, 1974

[21] Appl. No.: 531,911

[52] U.S. Cl. ..... 250/239; 250/214 AL; 315/159

[51] Int. Cl.[2] ..... H05B 37/02; H01J 5/02

[58] Field of Search ..... 250/239, 214 AL; 315/149, 159, 194, 200, DIG. 4; 317/124; 313/51; 240/DIG. 6

[56] References Cited

UNITED STATES PATENTS

| | | | |
|---|---|---|---|
| 3,056,035 | 9/1962 | Bernheim | 250/239 |
| 3,163,768 | 12/1964 | Bernheim | 250/238 |
| 3,341,711 | 9/1967 | Shepard | 250/239 |
| 3,401,265 | 9/1968 | Dotto | 315/159 X |
| 3,408,501 | 10/1968 | Thompson | 250/239 |

*Primary Examiner*—Eugene La Roche
*Attorney, Agent, or Firm*—Cesari and McKenna

[57] ABSTRACT

A light-sensitive lamp adaptor is small enough to fit in most indoor or outdoor lamps between the lamp socket and the light bulb. The adapter contains a solid state electronic circuit including a photocell which is in good thermal contact with the thermally conductive base of the adapter so that these electrical components are not heated excessively. A small window in the side of the adapter is movable about the axis of the adapter so that the photocell will respond only to light incident on the window from a given direction and the size of the window can be adjusted so that the unit will respond only to light of a given intensity.

1 Claim, 6 Drawing Figures

FIG. 5
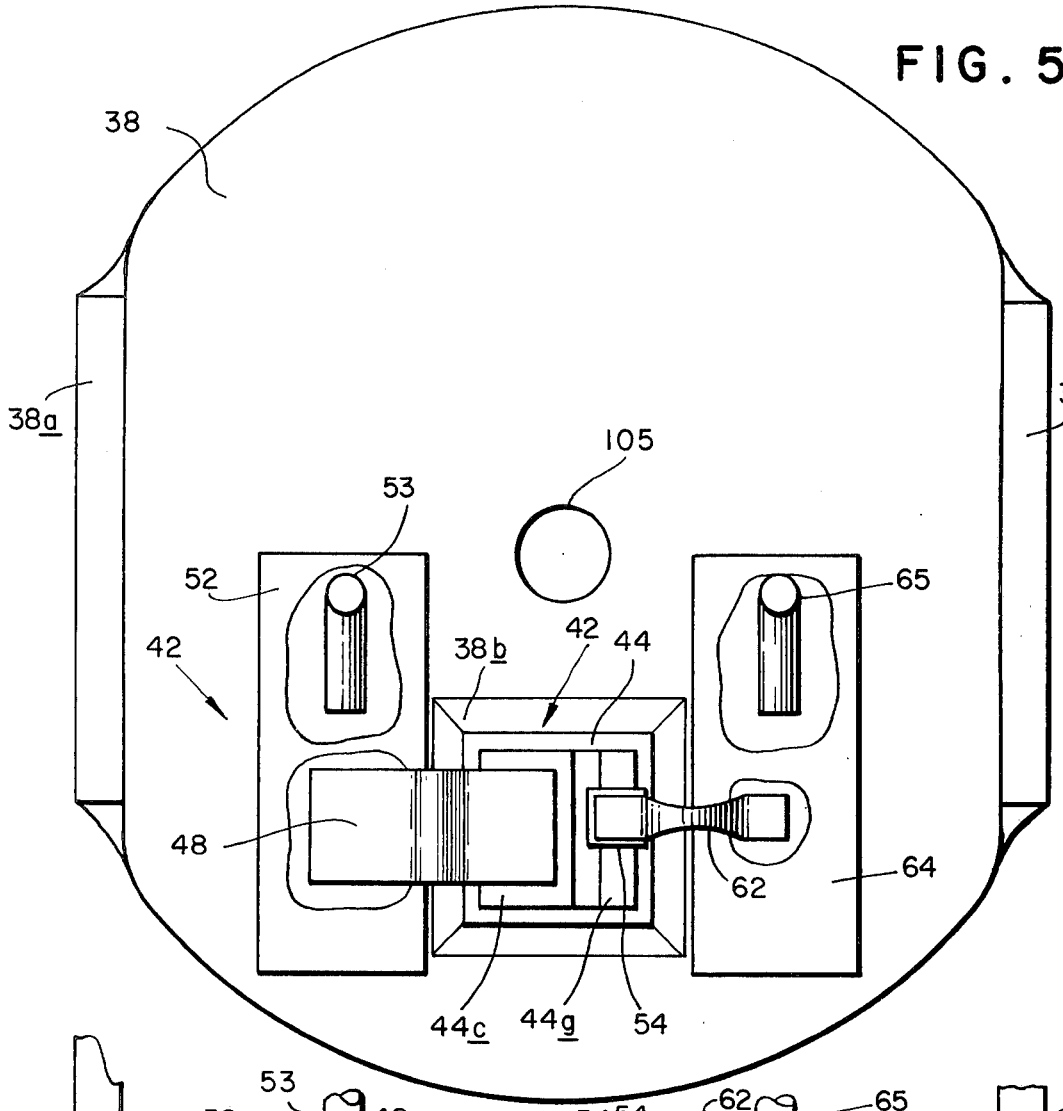
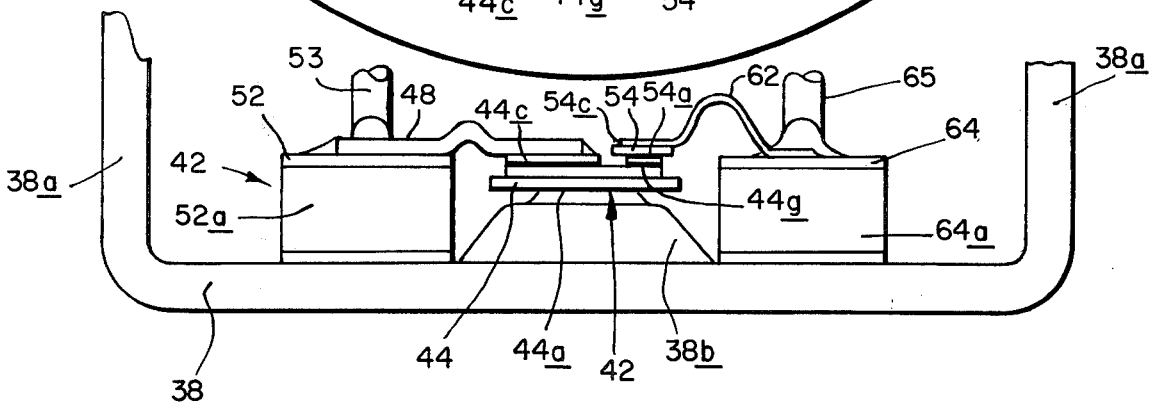
FIG. 6

LIGHT SENSITIVE LAMP ADAPTER

BACKGROUND OF THE INVENTION

This invention relates to a light-sentitive lamp adapter. It relates more particularly to a solid state light-sensitive electronic circuit which is housed in an adpater socket designed to be positioned between a light bulb and a conventional lamp socket.

Light-sensitive switches have been available for many years. Also, lamp adapters incorporating switches are in being. However, these prior adapters are not entirely satisfactory for a variety of reasons. Some of them are quite large and bulky so that they do not fit in many present-day lamps, particularly those of the enclosed variety. Others are quite directional so that they only respond to light incident upon them from a certain direction.

Other factors such as excessive cost and inflexibility of light level response have militated against the wider use and acceptance of light-sensitive lamp adapters of this general type.

SUMMARY OF THE INVENTION

Accordingly, it is an object of the present invention to provide a small, compact, light-sensitive lamp adapter.

Another object of the invention is to provide an adapter of this type for turning a lamp on and off at a selected light level.

Still another object of the invention is to provide a light-sensitive lamp adapter which can be adjusted to respond to light incident upon it from a given direction.

A further object of the invention is to provide a light-sensitive lamp adapter which is relatively inexpensive to make.

Yet another object of the invention is to provide an adapter which is reliable and should have a long, useful life.

Other objects will in part be obvious and will in part appear hereinafter.

The invention accordingly comprises the features of construction, combination of elements and arrangement of parts which will be exemplified in the construction hereinafter set forth and the scope of the invention will be indicated in the claims.

The present light-sensitive adapter is in the form of an extension of the conventional light bulb socket. It has a base at one end that screws into the socket and, at the other end, it has a socket into which a bulb can be screwed. The light-sensitive electronic circuitry is entirely contained within the adapter and an adjustable window on the side of the adapter allows the user to have the adapter respond only to light of a selected intensity and incident on the adapter from a given direction.

The adapter is also characterized by both reliability and low cost as well as small size largely because of the makeup of its internal electronic circuitry and the mode of mounting that circuitry. For example, it includes a novel solid state switch arrangement in the form of an integral triac/diac chip assembly which is mounted directly to a metallic disk positioned against the base of the adapter. This assembly substantially reduces the parts and assembly costs associated with the switch.

In terms of size, low cost and versatility, then, the present light-sensitive lamp adapter should find wide commercial acceptance as a device for turning on both indoor and outdoor lamps to illuminate sidewalks, doorways and rooms.

BRIEF DESCRIPTION OF THE DRAWINGS

For a fuller understanding of the nature and objects of the invention, reference should be had to the following detailed description taken in connection with the accompanying drawings, in which:

FIG. 5 is a top plan view on a greatly enlarged scale showing a component of the adapter; and FIG. 6 is a side elevation of the same component.

DESCRIPTION OF THE PREFERRED EMBODIMENT

Figure 1:
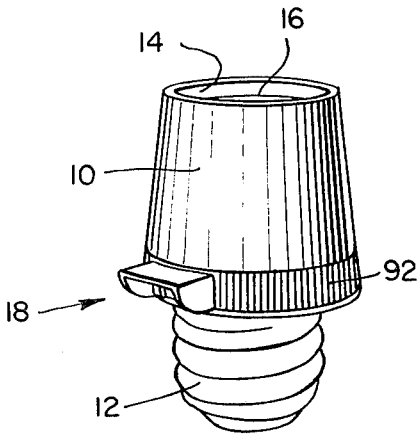
FIG. 1 is a perspective view of a light-sensitive lamp adapter embodying the principles of this invention.

Referring to FIG. 1 of the drawing, a one-piece light-sensitive lamp adapter has a molded housing 10 of a suitable impact-resistant electrical insulating material in which the various parts are mounted. A conventional lamp base shell 12 projects from the lower end of the housing and a cavity 14 in the upper end of the housing contains a conventional lamp socket shell 16. In use, the lamp base shell 12 is screwed into the light socket of a standard lamp whose own switch is turned on. Then a bulb is screwed down into shell 16.

A window assembly shown generally at 18 is rotatively mounted on housing 10 so that it can be swung about the housing axis. Window assembly 18 is pointed toward the light source which the user wishes the adapter to respond to. This may be a window, another lamp, or if the unit is controlling an outdoor lamp, the window assembly 18 can point in any one of a number of directions as will be seen later.

As long as light of a selected intensity is incident on the window assembly, the base shell 12 will remain electrically isolated from the socket shell 16. Accordingly, a bulb in the adapter will remain off. However, when the light incident on window assembly 18 diminishes below that selected intensity, an electrical connection is completed between shell 12 and shell 16 causing a bulb in the adapter to be turned on. Within certain limits, the user may select the light intensity level to which the adapter will respond, by properly orienting a window assembly 18. This will also be discussed in complete detail later.

Figure 2:
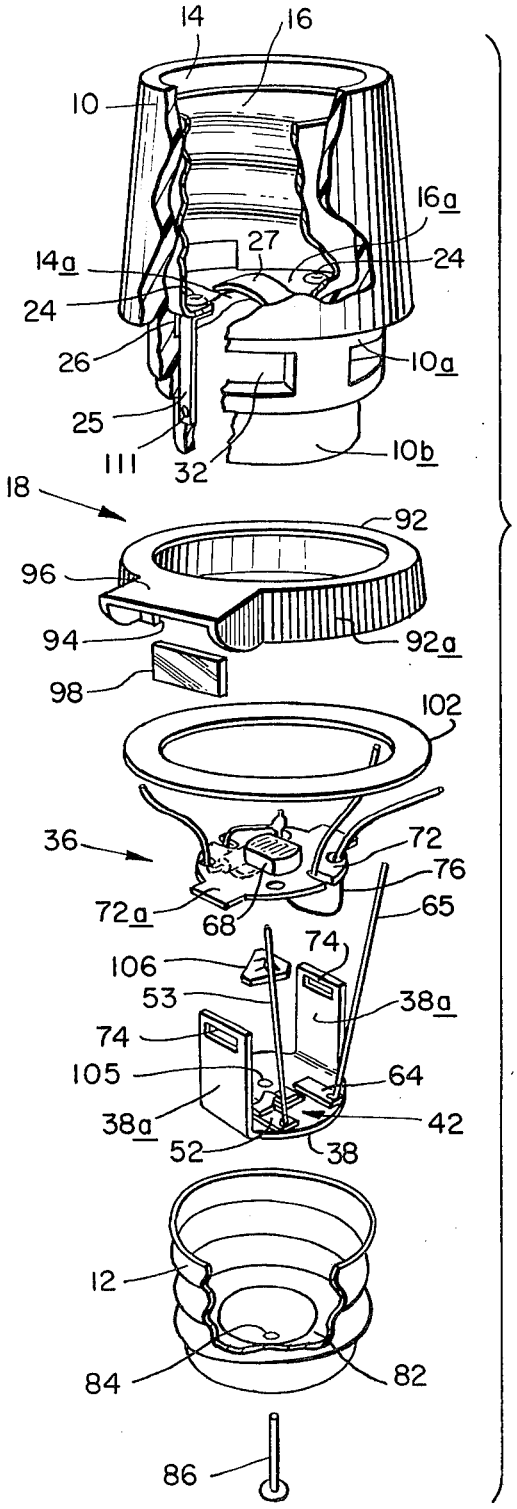
FIG. 2 is an exploded perspective view of the adapter on a larger scale with parts cut away.
Figure 3:
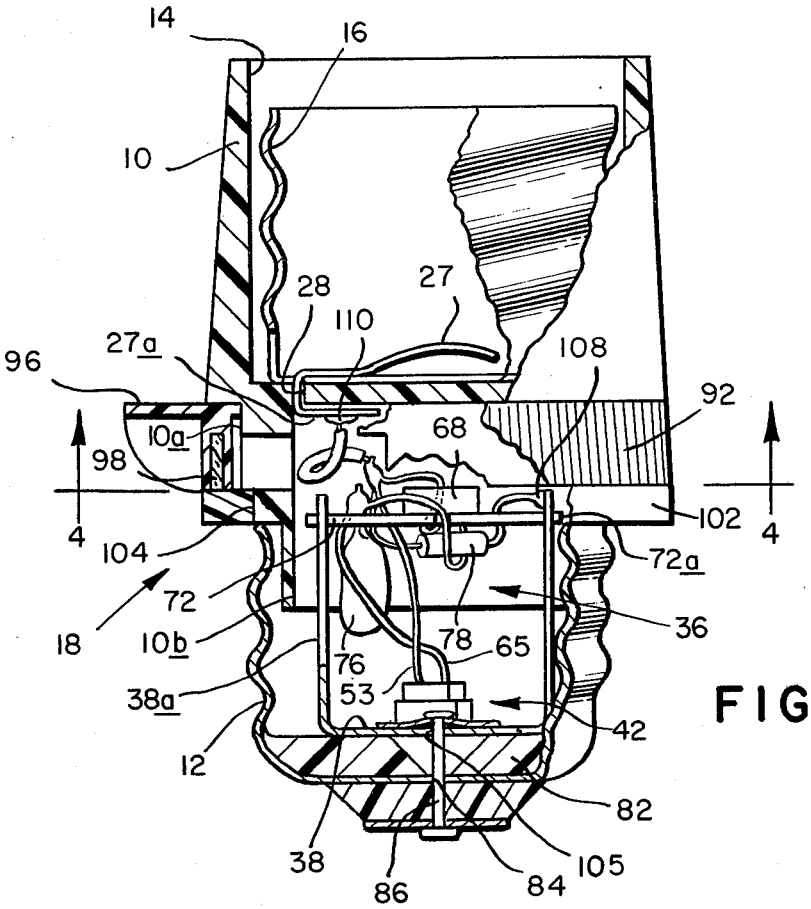
FIG. 3 is a view in side elevation with parts cut away on a still larger scale showing the adapter in greater detail.

Turning now to FIGS. 2 and 3, the socket shell 16 is secured to the bottom wall **14*a* of cavity 14 by means of rivets 24. As best seen in FIG. 2, each rivet 24 fastens in place against the shell 16 a tab 25 that extends down through a small slot 26 in wall 14a for connection to the shell 12.**

Socket shell 16 has an opening in its bottom wall at **16*a*. A socket center contact 27, disposed in the opening 16*a* has an integral tab 27*a* which extends down through a slot 28 in wall 14*a* and is turned under that wall to hold the contact in place. Housing 10 has a depending reduced diameter cylindrical extension 10*a* formed with three radial windows 32 evenly distributed about its axis. An even smaller diameter cylindrical skirt 10***b* extends down from extension 10*a* just inboard of the tabs 25, which pass through non-window portions of the extension 10*a*.

The light-sensitive electronic assembly is shown generally at 36. FIGS. 5 and 6 show it to include a disk 38 with two opposed integral tabs 38*a* projecting up from its edge. Disk 38 is stamped to form an upstanding pedestal 38*b* offset from its center. Mounted on disk 38 is a special triac/diac chip assembly shown generally at 42. Assembly 42 includes a triac chip 44 which is electrically and thermally connected to disk 38 by soldering its flat anode terminal 44*a* to the top of pedestal 38*b*. The cathode electrode 44*c* of the triac is electrically connected by way of a conductive strap 48 to conductive pad 52. Pad 52 is, in turn, secured to plate 38 by means of an electrically insulating pad 52*a* and an electrical lead 53 in turn is soldered to pad 52.

The diac component of assembly 42 consists of a disc chip 54 whose anode 54*a* is soldered to the triac gate electrode 44*g*. The diac cathode 54*c* is connected by a conductive strap 62 to a conductive pad 64 which is fastened on, but insulated from, plate 38 by an insulating pad 64*a*. Also, a lead 65 is soldered to the pad.

The triac/diac assembly 42 thus has a minimum number of parts and can be made in large quantities in a separate manufacturing operation and subsequently assembled into the adapter. Consequently, it contributes substantially to the low cost of the adapter.

Referring again to FIGS. 2, 3 and 4, assembly 36 also includes a photocell 68 which is mounted on the top of an insulating disk 72. Disk 72 is secured to the upstanding tabs 38*a* by means of laterally extending tabs 72*a* which project into slots 74 in the tabs 38*a*. The disk 72 also carries a timing capacitor 76 and a charging resistor 78 (FIG. 3). The capacitor 76 is electrically connected across the photocell 68 and one terminal of the resistor 78 is connected to the junction of the capacitor and photocell.

The lamp base shell 12 is quite conventional, being filled with an insulating layer 82, generally of lime glass. The shell has a hole 84 at its bottom for accomodating a center-contact rivet 86.

Window assembly 18 comprises a ring 92 whose inside diameter is slightly larger than the outside diameter of housing extension 10*a*. The rim 92*a* of the ring is serrated of knurled so that it can be gripped easily by the user. Ring 92 has a small rectangular window 94 at one side of the ring, which window is protected by an overhanging cowl 96. The top and side walls of window 94 are slotted to receive a small, transparent, rectangular plate 98 of glass, plastic or the like. In use, the ring 92 is slid onto housing extension 10*a* and retained there by a plastic ring 102 which is press-fit onto a necked-down portion 104 at the lower end of housing extension 10*a*.

The adapter is assembled by first inserting the socket shell 16 into housing cavity 14 and then installing the rivets 24 and upsetting the lower ends of the rivets projecting through the bottom wall 14*a*. At this point, the tabs 25 extend down through their respective slots 26 and are situated adjacent the skirt 10*b*. Next, the center contact 27 is inserted through the slot 28 provided in bottom wall 14*a* and its tab 27*a* is turned under and pressed up against the underside of wall 14*a*.

Also, the disk 38 carrying the triac/diac chip is inserted into the base 12 so that the disk 38 rests upon the insulating layer 82. The contact rivet 86 is then inserted upwardly through the opening 84 in the base and through a corresponding hole 105 in disk 38 (FIGS. 2 and 5). Then a push-nut 106 is pressed down over the upper protruding end of the rivet 86 to secure the disk against the layer 82 and also provide an electrical connection between the contact head of rivet 86 and the triac anode 44*a* by way of disk 38.

Next, the disk 72 supporting the photocell 68 is connected to pedestals 38 by inserting the tabs 72*a* into the slots 74 and the various electrical components are connected together. More particularly, the remaining unconnected lead of resistor 78 is connected to the triac anode 44*a*. This is accomplished conveniently by soldering that lead to an accessible edge portion of pedestal 38*a* as shown at 108 in FIG. 3. The lead 65 extending up from the pad 64 is then connected to the junction of photocell 68, capacitor 76 and resistor 78. Finally, the lead 53 from the pad 52 is soldered to the other junction of photocell 68 and capacitor 76 and a connection is made from this junction to the tab 27*a* of center contact 27 as shown at 110 in FIG. 3.

Solder balls 111 are then applied to the exposed ends of tabs 25 as seen in FIG. 2 and base 12 is pushed up over skirt 10*b* so that the upper edge of the base overlies the solder balls. Next, a hot iron is placed against the outside of base shell 12 opposite the solder balls to melt the solder which, when it resolidifies, firmly anchors the base to housing 10 and electrically connects it to shell 14. Finally, the ring 92 with its window 98 in place is slid over extension 10*a* and the ring 102 is snapped onto the necked down portion 104 to secure the ring to the housing while allowing it to rotate about the housing axis.

These steps lock in place both the base 12 and housing 10 without the use of any adhesive and yet securly enough to meet the standard torque and pull-apart specifications. They also insure good electrical contact between socket shell 16 and base shell 12. The other electrical path from the rivet 86 to the upper center contact 27 extends through disk 38, the anode and cathode electrodes of the triac chip 44 and the lead 53.

The overall conductivity of the path between rivet 86 and contact 27 depends upon the amount of light incident on photocell 68. When a large light flux is incident on the photocell, its resistance decreases, thereby preventing a voltage buildup across it which is sufficient to fire diac 54. Consequently, the triac does not conduct and there is no electrical connection between rivet 86 and contact 27. When minimal or no light is incident upon the photocell, however, its resistance is high enough to fire the diac so that the triac conducts and and completes the connection between rivet 86 and contact 27.

Figure 4:
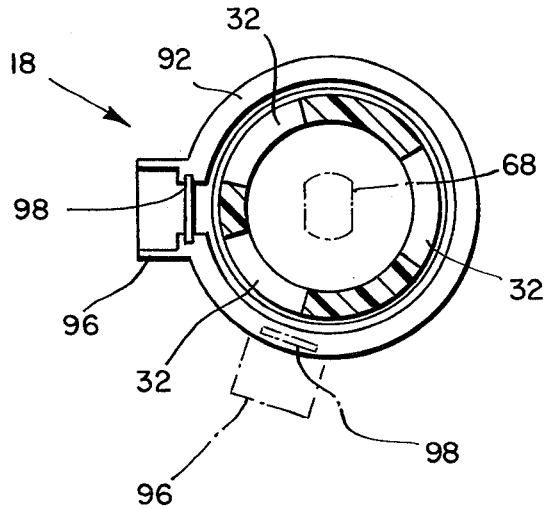
FIG. 4 is a sectional view on a smaller scale taken along line 4—4 of FIG. 3.

As best seen in FIGS. 3 and 4, the window assembly 18 is designed so that when the adapter is in place, the window 94 can be rotated a full 360° relative to the adapter axis. This means that the user can position the window 94 opposite any one of the three openings 32 in the housing extension 10*a* so that the photocell will receive light only from a given direction. Thus, the window 98 can be positioned opposite the opening 32 nearest a house window so that the adapter will turn on after sunset even though there may be some artificial light present in the vicinity of the adapter.

Also, assembly 18 allows the user to keep the associated lamp on no matter what the ambient light conditions are. This simply involves positioning the window 98 opposite a segment of housing extension 10*a* between adjacent openings 32 as shown in solid lines in FIG. 4. The photocell will receive no light and the adapter will remain in its on state.

By the same token, the user can adjust assembly 18 so that the adapter will respond to a selected light level. To do this, he merely turns assembly 18 so that only a selected segment of window 92 lies opposite one of the openings 32 as shown in dotted lines in FIG. 4. As the amount of overlap between window 98 and opening 32 decreases, less light impinges on the photocell for a given ambient light condition so that the adapter turns on sooner than would be the case if the window is directly opposite an opening 32.

In summary, then, the present light-sensitive lamp adapter is compact, unobtrusive and easy to adjust by the average homeowner. The user can select the light level at which the adapter is to operate and he can even choose the source of the light which the adapter will respond to.

Finally, the adapter is made from standard inexpensive electrical components that are easily assembled as described above so that its overall manufacturing cost is relatively low.

It will thus be seen that the objects set forth above, among those made apparent from the preceding description, are efficiently attained and, since certain changes may be made in invention, it is intended that all matter contained in the above description, or shown in the accompanying drawings, shall be interpreted as illustrative and not in a limiting sense.

It is also to be understood that the following claims are intended to cover all of the generic and specific features herein described.

I claim:

1. A light-sensitive lamp adapter comprising

A. an opaque housing having first and second ends and a first cavity opening into the first end, B. a lamp socket shell positioned in said cavity, C. a lamp base having a base shell and secured to the second end, D. means electrically interconnecting the shells, E. first and second center contacts in the bottoms of said socket and base shells, respectively, F. means defining a plurality of fixed windows in the housing distributed in a circle all around the longitudinal axis of the housing, at least one said window being separated from an adjacent window by an area of said opaque housing, G. a switch in the housing connected for conduction between the center contacts, H. a photocell positioned in the housing adjacent the fixed windows and fixed to said housing, said photocell aligned to be illuminated by light from any direction about the longitudinal axis of said housing, for controlling the switch so that the switch turns on or off depending upon the intensity of the light incident on the photocell, and I. movable window means rotatively mounted on the housing for movement in a circle all around said axis for selective alignment with any one of the fixed windows so that ambient light from any given direction can be incident on the photocell, the area of said movable window being no greater than said opaque housing area so that when said movable window is aligned with said opaque area no light reaches said photocell.

* * * * *